US006193386B1

(12) United States Patent
Reynolds

(10) Patent No.: US 6,193,386 B1
(45) Date of Patent: Feb. 27, 2001

(54) ILLUMINATED TELESCOPIC INSPECTION/PICKUP TOOL

(75) Inventor: Mark Franklin Reynolds, Langley (CA)

(73) Assignee: Carica USA, Inc., Scottsdale, AZ (US)

( * ) Notice: Subject to any disclaimer, the term of this patent is extended or adjusted under 35 U.S.C. 154(b) by 0 days.

(21) Appl. No.: 09/138,871

(22) Filed: Aug. 24, 1998

(51) Int. Cl.[7] ..... F21V 33/00

(52) U.S. Cl. ..... 362/109; 362/139; 362/119; 362/120; 362/141

(58) Field of Search ..... 362/187, 119, 362/138, 139, 120, 109, 190, 198, 418

(56) References Cited

U.S. PATENT DOCUMENTS

| | | | | |
|---|---|---|---|---|
| 4,286,311 | * | 8/1981 | Maglica | 362/187 |
| 5,381,319 | * | 1/1995 | Shiao | 362/120 |
| 5,528,472 | * | 6/1996 | Maglica et al. | 362/202 |
| 5,636,918 | * | 6/1997 | Lott | 362/139 |
| 5,647,623 | * | 7/1997 | Shiao | 362/109 |
| 5,915,825 | * | 6/1999 | Weister | 362/139 |
| 5,951,142 | * | 9/1999 | Wang et al. | 362/109 |

* cited by examiner

*Primary Examiner*—Sandra O'Shea
*Assistant Examiner*—David V. Hobden
(74) *Attorney, Agent, or Firm*—Jeffrey Weiss; Jeffrey Moy; Weiss & Moy, P.C.

(57) ABSTRACT

An inspection/pickup tool having a casing within which a telescopically extendible rod is mounted for telescopic extension in a direction away from the casing. A quick connect-disconnect coupler is provided on the outward end of the rod for removably coupling a selected inspection/pickup head to the rod. A light is mounted within the casing to emit light in the direction in which the rod extends. A focusing mechanism is provided for focusing the light. For example, a lens can be mounted over the light for selectable advancement and retraction of the lens with respect to the light. The casing is shaped for single-handed manipulation of the inspection/pickup head and for simultaneous single-handed activation and focusing of the light. This is achieved by providing a button on the casing in a location where the button can be depressed to activate the light by a hand which is holding the casing and manipulating the inspection/pickup head; and, by mounting a rotatable bezel containing the lens on the casing for selectable advancement and retraction of the lens with respect to the light by rotating the bezel with the same hand.

6 Claims, 4 Drawing Sheets

ILLUMINATED TELESCOPIC INSPECTION/PICKUP TOOL

TECHNICAL FIELD

This application pertains to a tool having a telescopic holder on which a inspection or pickup head can be interchangeably mounted and which incorporates a light for illuminating the region into which the selected head is telescopically extended.

BACKGROUND

Telescopic tools having interchangeable pickup and inspection heads such as mirrors, magnifiers and magnetic pickups are well known. See for example United States design patent numbers D379,656 and D378,337. Such tools are used to inspect and/or retrieve objects in a variety of hard-to-reach situations. For example, mechanics use such tools to inspect and/or retrieve components located within an automobile engine compartment. A slim telescopic rod having a small pickup or inspection head mounted at its end can be fed through comparatively small spaces and positioned to enable the mechanic to inspect engine components retrieve a loose component which may have been inadvertently dropped, etc.

Sometimes, it is necessary to use such tools in regions which are not well illuminated. For example, the interior regions of vehicle engine compartments are not normally well illuminated, making it difficult for the mechanic to see components located in such regions. The lack of illumination diminishes the efficiency of the inspection/pickup tool. Although a trouble light, flashlight, etc. can be used to provide illumination, this requires the mechanic to locate and bring to the work site a separate illuminating device. Moreover, if an illuminating device such as a hand-held flashlight is used, both of the mechanic's hands will be occupied (i.e. one hand is needed to hold the inspection/pickup tool and the other hand is needed to hold the flashlight). Further, many trouble lights, flashlights, etc. do not provide a light beam which can be selectably focused.

The foregoing disadvantages are overcome by the present invention, which provides a telescopic pickup/inspection tool having a plurality of interchangeable heads and having an integrated, selectably focusable illumination capability.

The prior art has evolved inspection/pickup tools having an integral illumination capability. For example, one prior art tool incorporates a lucite rod for projecting light and a mirror which can be clipped onto the rod. Another prior art tool mounts a small light bulb at the end of a telescopic rod adjacent a pivotable mirror on which the light shines. However, the illumination capability of such prior art devices tends to be poor and cannot be selectably focused while the pickup/inspection tool is being used for inspection/pickup purposes.

SUMMARY OF INVENTION

In accordance with the preferred embodiment, the invention provides an inspection/pickup tool having a casing within which a telescopically extendible rod is mounted for telescopic extension in a direction away from the casing. A mounting means such as a quick connect/disconnect coupler is provided on the outward end of the rod for removably coupling a selected inspection/pickup head to the rod. A light is mounted within the casing to emit light in the direction in which the rod extends.

A focusing means is provided for focusing the light. For example, a lens can be mounted over the light and selectably advanced or retracted with respect to the light. Preferably, the casing is shaped for single-handed manipulation of the inspection/pickup head and simultaneous single-handed activation and focusing of the light. This can be achieved by providing a button on the casing in a location where the button can be depressed to activate the light by a hand which is holding the casing and manipulating the inspection/pickup head; and, by mounting a rotatable bezel containing the lens on the casing for selectable advancement and retraction of the lens with respect to the light by rotating the bezel with the same hand.

DESCRIPTION

The drawings depict a device 10 having a telescopically extendable rod 12 mounted in longitudinal alignment beneath an illuminating head 14. A quick connect/disconnect coupler 16 is fixed on the end of rod 12 for interchangeable, quick connect/disconnect mounting of any one of a plurality of inspection or pickup heads (not shown in FIGS. 1–6) such as mirrors, magnifiers or magnetic pickups.

Figure 6:
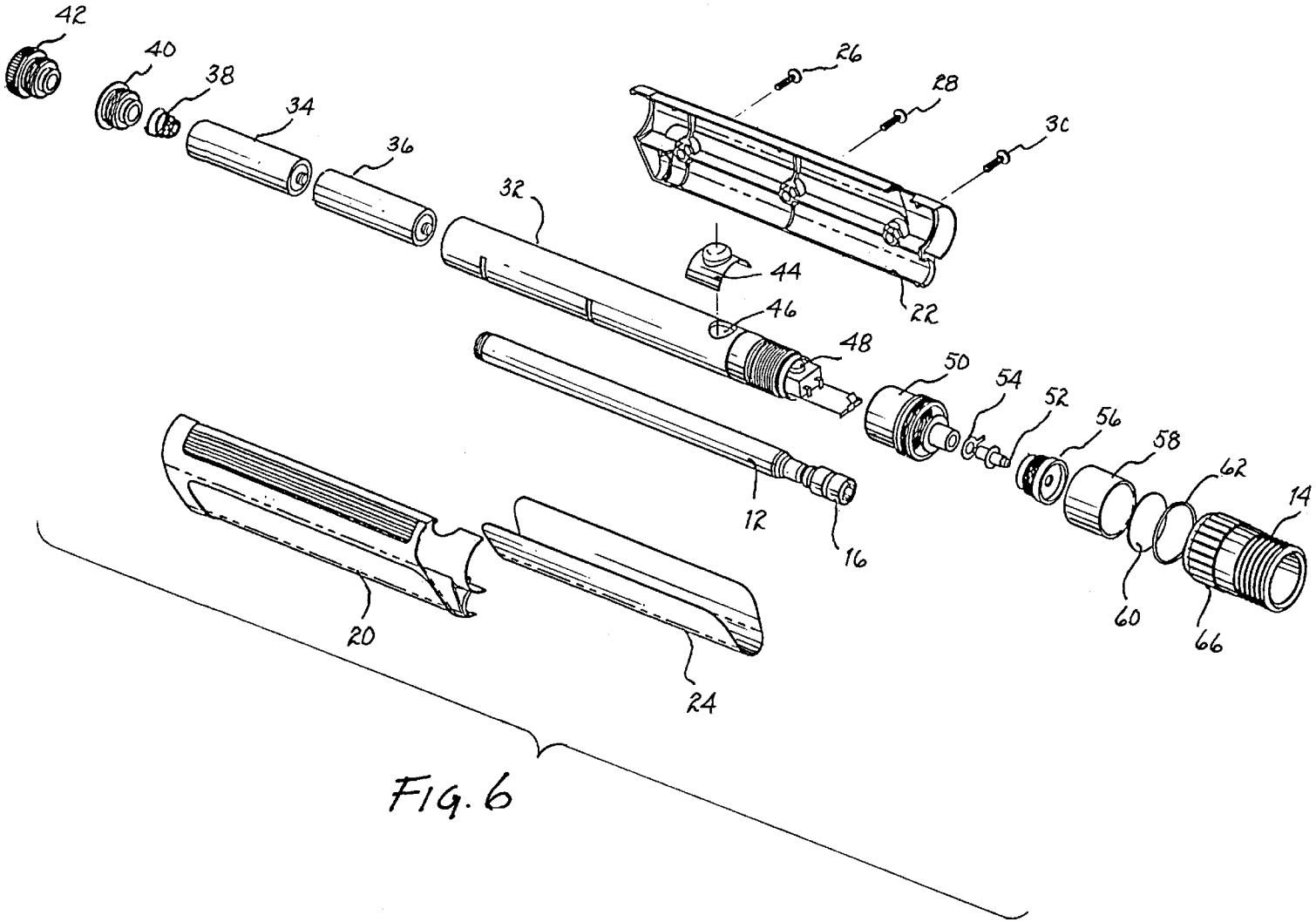
FIG. 6 is an exploded view of the FIG. 1 embodiment.

A casing 18 serves as a mounting platform for telescopic rod 12 and illuminating head 14. As best seen in FIG. 6, casing 18 consists of left and right halves 20, 22. Left and right casing halves 20, 22 are fastened together by means of screws 26, 28, 30 to form upper and lower interior compartments within casing 18. The lower compartment contains U-shaped sleeve 24, which supports the non-extendable rearward portion of telescopic rod 12. The upper compartment contains components associated with illumination head 14, as will now be described.

As best seen in FIG. 6, a tube 32 is provided within the upper compartment to contain replaceable batteries 34, 36 which provide illumination power. Spring 38 and spring retainer 40 maintain proper electrical connection between batteries 34, 36 and the remaining electrical components when end cap 42 is threadably fastened onto the end of tube 32. Push button 44 is mounted within the upper compartment of casing 18, above aperture 46 in tube 32. Switch 48 protrudes upwardly through aperture 46 so that switch 48 can be activated by depressing button 44. Bulb retainer 50 is internally threaded at its rearward end for mating, threaded engagement with external threads provided on the forward end of tube 32, opposite end cap 42. Replaceable light bulb 52 and snap ring 54 are fitted onto bulb retainer 50 in conventional fashion. Reflector 56 is externally threaded at its rearward end for mating, threaded engagement with internal threads provided in the forward end of bulb retainer 50 such that light bulb 52 projects through reflector 56 within light conduit 58. Lens 60 is fitted over the outward end of conduit 58 and O-ring 62 circumferentially surrounds the outward face of lens 60. Conduit 58, lens 60 and O-ring 62 are held inside the tubular rearward end of illumination head 14, which is internally threaded for mating, threaded engagement with external threads provided on the forward end of bulb retainer 50.

Figure 7:
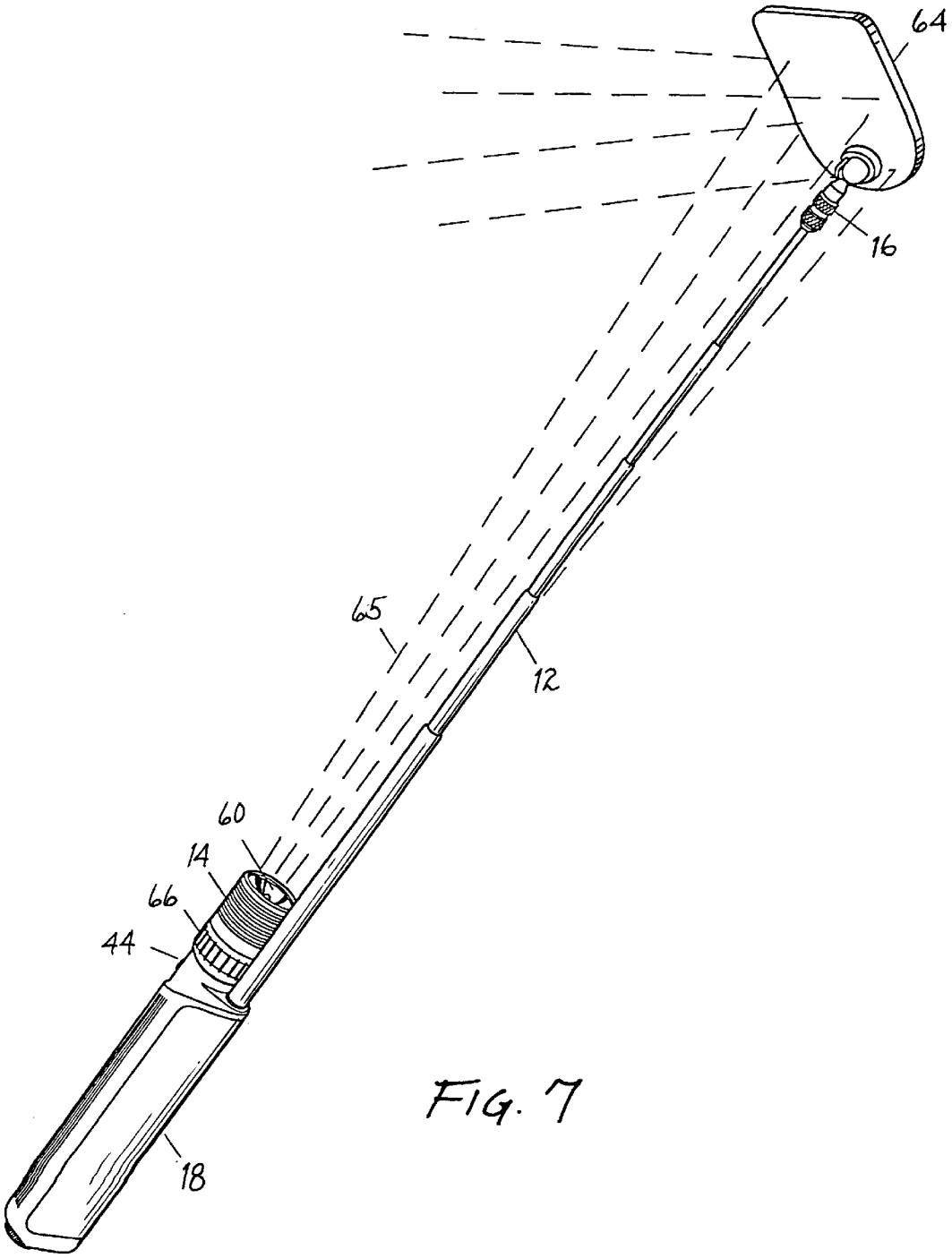
FIG. 7 is a pictorial illustration of the FIG. 1 embodiment, showing the telescopic rod extended to position an inspection mirror in a selected location illuminated by the invention.

In operation, a suitable inspection or pickup head such as mirror 64 (FIG. 7) is selected and fitted onto the end of telescopic rod 12 via coupler 16 (a mating quick connect/disconnect coupler being provided on mirror 64). Rod 12 is then telescopically extended to a suitable length and casing 18 grasped in one hand to extend mirror 64 into a region which is to be viewed with the aid of mirror 64. If that region is inadequately illuminated then button 44 is depressed with the thumb of the hand in which casing 18 is held. This activates light bulb 52, which projects an illuminating light beam 65 through lens 60 and illumination head 14. If necessary, the beam can be focused by rotating knurled bezel 66 between the thumb and forefinger of the same hand in which casing 18 is held. Such rotation threadably advances or retracts illumination head 14 with respect to bulb retainer 50 thereby selectably positioning lens 60 with respect to light bulb 52 to accomplish the desired focusing of the light beam.

Figure 1:
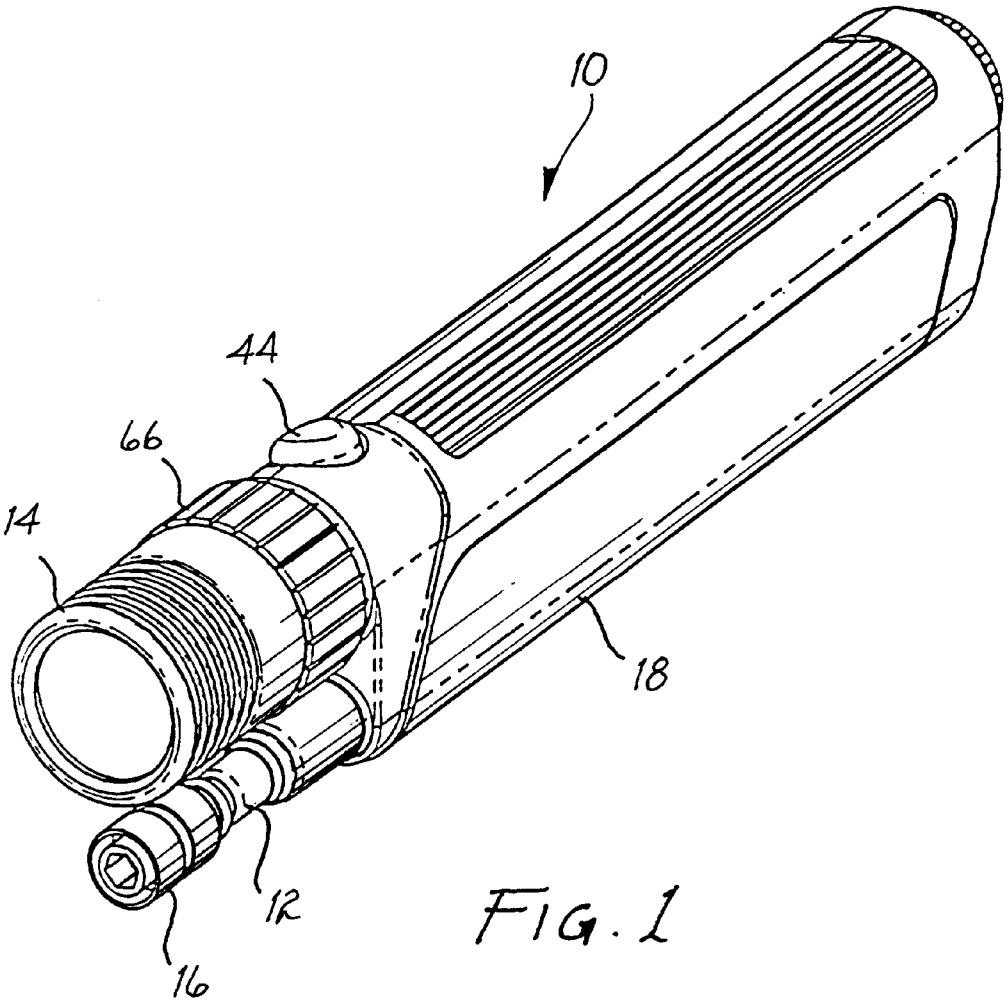
FIG. 1 is a pictorial illustration of a telescopic pickup/inspection tool having an integrated illumination capability in accordance with the invention.
Figure 5:
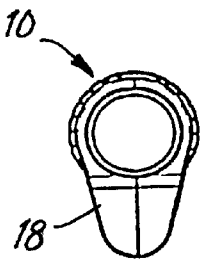
FIG. 5 is a rear elevation view of the FIG. 1 embodiment.
Figure 2:
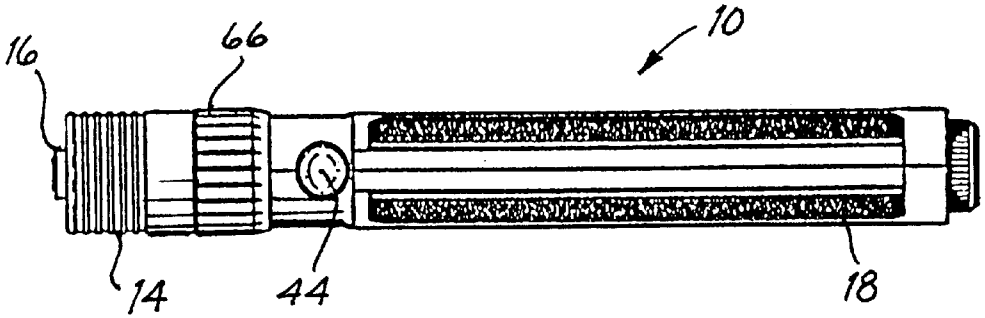
FIG. 2 is a top plan view of the FIG. 1 embodiment.
Figure 3:
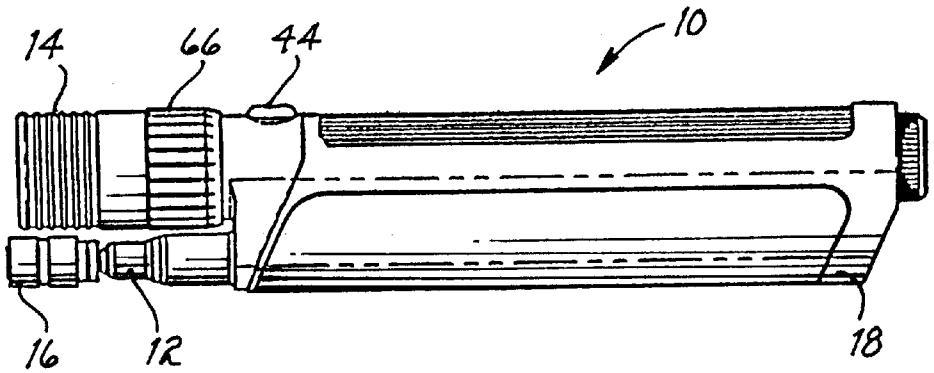
FIG. 3 is a side elevation view of the FIG. 1 embodiment.
Figure 4:
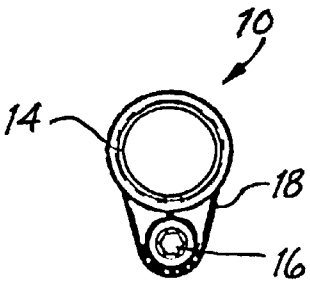
FIG. 4 is a front elevation view of the FIG. 1 embodiment.

As will be apparent to those skilled in the art in the light of the foregoing disclosure, many alterations and modifications are possible in the practice of this invention without departing from the spirit or scope thereof. For example, instead of mounting rod 12 beneath illumination head 14 as shown in FIG. 1, one could mount rod 12 above illumination head 14. Further, a magnetic mounting device could be provided on device 10 to enable the operator to magnetically attach device 10 at a convenient point to facilitate hands-free use thereof. Also, rod 12 could be provided with a non-rotating characteristic (i.e. by making the telescoping portions of rod 12 eccentric or square in cross-section) to prevent unintended rotation of the inspection or pickup head fitted on the end of the extended rod. As another example, batteries 34, 36 could be rechargeable and a suitable adaptor provided on device 10 for coupling to a battery recharger. The scope of the invention is to be construed in accordance with the substance defined by the following claims.

What is claimed is:

1. An inspection/pickup tool comprising:

(a) a casing fully enclosing one end of a telescopically extendible rod and one end of a light, said casing forming an ergonomically shaped hand grip, said rod having an outward end telescopically extendible in a direction away from said casing, said light aligned with said rod to emit light in said direction; and (b) a spring-loaded quick connect/disconnect coupler on said outward end of said rod for manual, tool-free interchangeable mounting of any one of a plurality of inspection/pickup heads on said outward end of said rod.

2. An inspection/pickup tool as defined in claim 1, further comprising focusing means for focusing said light.

3. An inspection/pickup tool as defined in claim 1, further comprising a lens mounted over said light for selectable advancement and retraction of said lens with respect to said light.

4. An inspection/pickup tool as defined in claim 3, wherein said casing is further ergonomically shaped for single-handed manipulation of said one of said inspection/pickup heads and for simultaneous single-handed activation and focusing of light emitted through said lens by said light.

5. An inspection/pickup tool as defined in claim 3, further comprising:

(a) a button mounted on said casing and electrically coupled to said light for activation of said button by a hand holding said casing and manipulating said one of said inspection/pickup heads; and, (b) a rotatable bezel containing said lens and mounted on said casing for selectable advancement and retraction of said lens with respect to said light by rotation of said bezel by said hand.

6. An inspection/pickup tool as defined in claim 3, further comprising:

(a) a first compartment within said casing for supportably containing said one end of said rod; and, (b) a second compartment within said casing for supportably containing a power source for said light.

* * * * *